US010247009B2

(12) United States Patent
Myers et al.

(10) Patent No.: US 10,247,009 B2
(45) Date of Patent: Apr. 2, 2019

(54) COOLING PASSAGE FOR GAS TURBINE SYSTEM ROTOR BLADE

(71) Applicant: General Electric Company, Schenectady, NY (US)

(72) Inventors: Melbourne James Myers, Woodruff, SC (US); Xiuzhang James Zhang, Simpsonville, SC (US); Stuart Samuel Collins, Simpsonville, SC (US); Camilo Andres Sampayo, Greer, SC (US); Joseph Block, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 409 days.

(21) Appl. No.: 15/163,061

(22) Filed: May 24, 2016

(65) Prior Publication Data

US 2017/0342841 A1 Nov. 30, 2017

(51) Int. Cl.

| | |
|---|---|
| ***F01D 5/08*** | (2006.01) |
| ***F01D 5/18*** | (2006.01) |
| *F01D 5/14* | (2006.01) |

(52) U.S. Cl.

CPC ..... *F01D 5/18* (2013.01); *F01D 5/082* (2013.01); *F01D 5/186* (2013.01); *F01D 5/143* (2013.01); *F05D 2220/32* (2013.01); *F05D 2240/304* (2013.01); *F05D 2240/306* (2013.01); *F05D 2240/81* (2013.01); *F05D 2260/20* (2013.01)

(58) Field of Classification Search

CPC ..... F01D 5/082

See application file for complete search history.

(56) References Cited

U.S. PATENT DOCUMENTS

| | | | | |
|---|---|---|---|---|
| 6,383,602 | B1 * | 5/2002 | Fric | F01D 5/186 415/115 |
| 6,390,775 | B1 | 5/2002 | Paz | |
| 6,416,284 | B1 | 7/2002 | Demers et al. | |

(Continued)

FOREIGN PATENT DOCUMENTS

| | | | |
|---|---|---|---|
| EP | 2 666 965 | A1 | 11/2013 |
| EP | 3 043 027 | A1 | 7/2016 |

(Continued)

OTHER PUBLICATIONS

Extended European Search Report and Opinion issued in connection with corresponding EP Application No. 17171269.8 dated Nov. 3, 2017.

*Primary Examiner* — Christopher Verdier
*Assistant Examiner* — Jason G Davis
(74) *Attorney, Agent, or Firm* — Dority & Manning, PA

(57) ABSTRACT

The present disclosure is directed to a rotor blade for a gas turbine system. The rotor blade includes a platform having a radially inner surface and a radially outer surface. A shank portion extends radially inwardly from the radially inner surface of the platform. The shank portion and the platform collectively define a shank pocket. An airfoil extends radially outwardly from the radially outer surface of the platform. The shank portion, the platform, and the airfoil collectively define a cooling passage extending from a cooling passage inlet defined by the shank portion or the platform and directly coupled to the shank pocket through the platform to a cooling passage outlet defined by the airfoil.

18 Claims, 6 Drawing Sheets

(56) References Cited

U.S. PATENT DOCUMENTS

| | | | | |
|---|---|---|---|---|
| 6,761,536 | B1 | 7/2004 | Bash et al. | |
| 6,951,447 | B2 | 10/2005 | Cherolis et al. | |
| 8,047,787 | B1 | 11/2011 | Liang | |
| 8,133,024 | B1 | 3/2012 | Liang | |
| 8,668,454 | B2 * | 3/2014 | Wiebe | F01D 5/18 416/97 R |
| 8,827,647 | B1 | 9/2014 | Liang | |
| 9,243,503 | B2 * | 1/2016 | Bunker | F01D 5/187 |
| 9,284,844 | B2 * | 3/2016 | Xu | F01D 5/186 |
| 2006/0127212 | A1 | 6/2006 | Durocher et al. | |
| 2012/0167389 | A1 * | 7/2012 | Lacy | B23P 6/002 29/889.1 |
| 2017/0152752 | A1 | 6/2017 | Myers et al. | |

FOREIGN PATENT DOCUMENTS

| | | | |
|---|---|---|---|
| EP | 3 181 816 | A1 | 6/2017 |
| WO | 2015/057310 | A2 | 4/2015 |

* cited by examiner

COOLING PASSAGE FOR GAS TURBINE SYSTEM ROTOR BLADE

FIELD OF THE TECHNOLOGY

The present disclosure generally relates to a gas turbine system. More particularly, the present disclosure relates to a rotor blade for a gas turbine system.

BACKGROUND

A gas turbine system generally includes a compressor section, a combustion section, a turbine section, and an exhaust section. The compressor section progressively increases the pressure of a working fluid entering the gas turbine system and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

The turbine section includes a plurality of rotor blades, which extract kinetic energy and/or thermal energy from the combustion gases flowing therethrough. These rotor blades generally operate in extremely high temperature environments. In order to achieve adequate service life, the rotor blades typically include an internal cooling circuit. During operation of the gas turbine, a cooling medium such as compressed air is routed through the internal cooling circuit to cool the rotor blade.

In some configurations, the cooling medium flows through a plurality of trailing edge passages extending through a trailing edge of the rotor blade. The cooling medium flowing through the plurality of trailing edge passages absorb heat from the portions of the airfoil proximate to the trailing edge, thereby cooling the trailing edge. Nevertheless, conventional trailing edge passage arrangements may not cool the portions of the airfoil trailing edge positioned radially inwardly from the plurality of the trailing edge cooling apertures.

BRIEF DESCRIPTION OF THE TECHNOLOGY

Aspects and advantages of the technology will be set forth in part in the following description, or may be obvious from the description, or may be learned through practice of the technology.

In one aspect, the present disclosure is directed to a rotor blade for a gas turbine system. The rotor blade includes a platform having a radially inner surface and a radially outer surface. A shank portion extends radially inwardly from the radially inner surface of the platform. The shank portion and the platform collectively define a shank pocket. An airfoil extends radially outwardly from the radially outer surface of the platform. The shank portion, the platform, and the airfoil collectively define a cooling passage extending from a cooling passage inlet defined by the shank portion or the platform and directly coupled to the shank pocket through the platform to a cooling passage outlet defined by the airfoil.

A further aspect of the present disclosure is directed to a gas turbine system having a compressor section, a combustion section, and a turbine section. The turbine section includes one or more rotor blades. Each rotor blade includes a platform having a radially inner surface and a radially outer surface. A shank portion extends radially inwardly from the radially inner surface of the platform. The shank portion and the platform collectively define a shank pocket. An airfoil extends radially outwardly from the radially outer surface of the platform. The shank portion, the platform, and the airfoil collectively define a cooling passage extending from a cooling passage inlet defined by the shank portion and directly coupled to the shank pocket through the platform to a cooling passage outlet defined by the airfoil.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended FIGS., in which.

Figure 1:
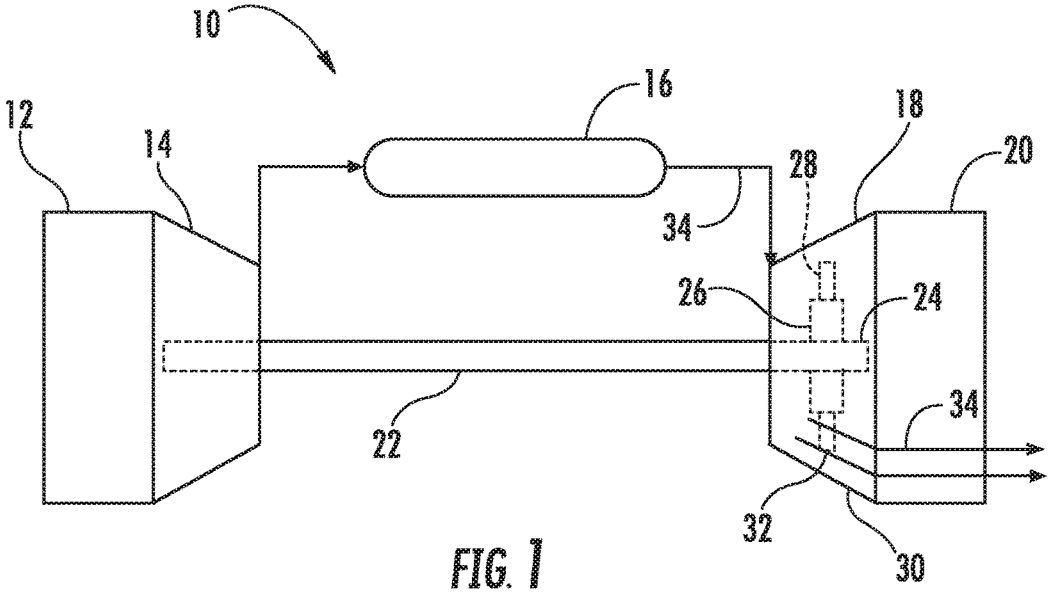
FIG. 1 is a schematic view of an exemplary gas turbine in accordance with the embodiments disclosed herein.

Repeat use of reference characters in the present specification and drawings is intended to represent the same or analogous features or elements of the present technology.

DETAILED DESCRIPTION OF THE TECHNOLOGY

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents. Although an industrial or land-based gas turbine is shown and described herein, the present technology as shown and described herein is not limited to a land-based and/or industrial gas turbine unless otherwise specified in the claims. For example, the technology as described herein may be used in any type of turbine including, but not limited to, aviation gas turbines (e.g., turbofans, etc.), steam turbines, and marine gas turbines.

Now referring to the drawings, wherein identical numerals indicate the same elements throughout the figures, FIG. 1 schematically illustrates a gas turbine system 10. It should be understood that the turbine system 10 of the present disclosure need not be a gas turbine system 10, but rather may be any suitable turbine system, such as a steam turbine system or other suitable system. The gas turbine system 10 may include an inlet section 12, a compressor section 14, a combustion section 16, a turbine section 18, and an exhaust section 20. The compressor section 14 and turbine section 18 may be coupled by a shaft 22. The shaft 22 may be a single shaft or a plurality of shaft segments coupled together to form the shaft 22.

The turbine section 18 may generally include a rotor shaft 24 having a plurality of rotor disks 26 (one of which is shown) and a plurality of rotor blades 28 extending radially outwardly from and being interconnected to the rotor disk 26. Each rotor disk 26 in turn, may be coupled to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, a working fluid such as air flows through the inlet section 12 and into the compressor section 14, where the air is progressively compressed to provide pressurized air to the combustors (not shown) in the combustion section 16. The pressurized air is mixed with fuel and burned within each combustor to produce combustion gases 34. The combustion gases 34 flow through the hot gas path 32 from the combustor section 16 into the turbine section 18, where energy (kinetic and/or thermal) is transferred from the combustion gases 34 to the rotor blades 28, thus causing the rotor shaft 24 to rotate. The mechanical rotational energy may then be used to power the compressor section 14 and/or to generate electricity. The combustion gases 34 exiting the turbine section 18 may then be exhausted from the gas turbine system 10 via the exhaust section 20.

Figure 2:
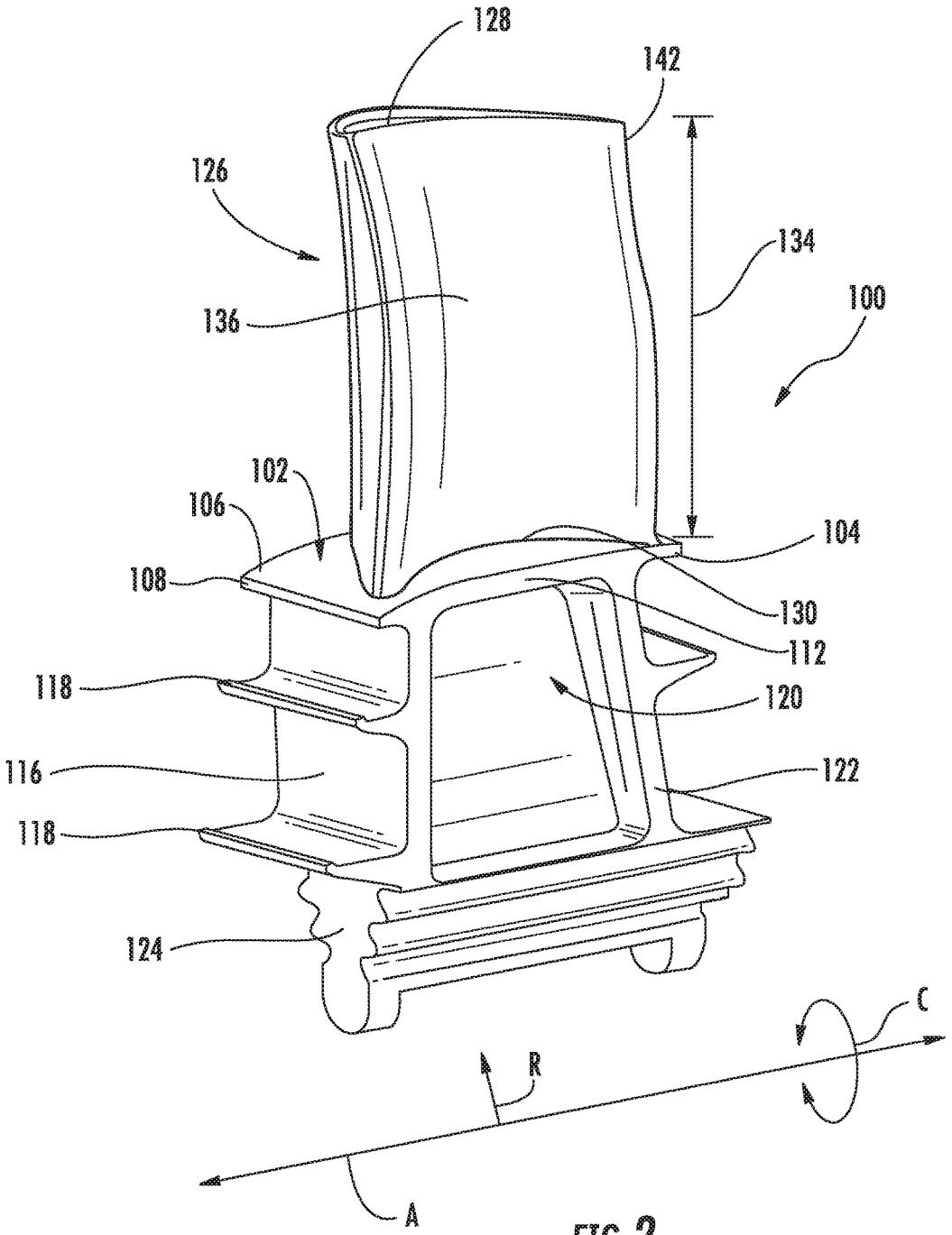
FIG. 2 is a perspective view of an exemplary rotor blade that may be incorporated in the gas turbine shown in FIG. 1 in accordance with the embodiments disclosed herein.
Figure 3:
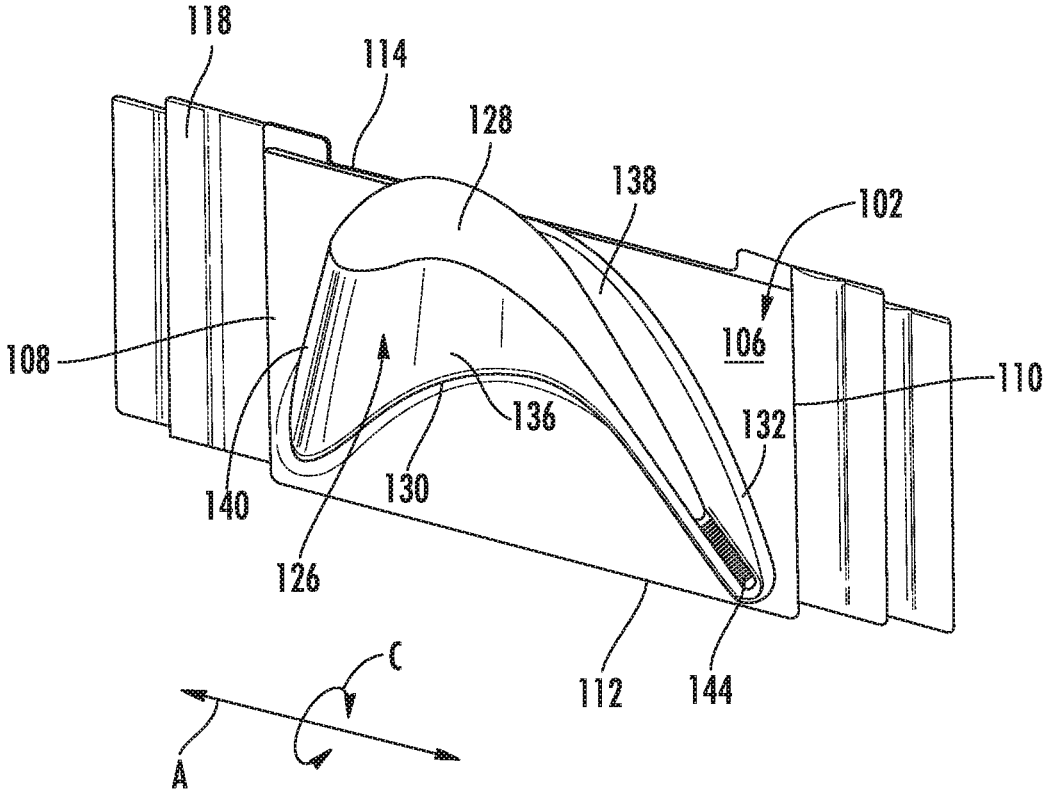
FIG. 3 is a top view of the exemplary rotor blade shown in FIG. 2, further illustrating various features thereof.

FIGS. 2 and 3 are views of an exemplary rotor blade 100, which may incorporate one or more embodiments disclosed herein and may be incorporated into the turbine section 18 of the gas turbine system 10 in place of the rotor blade 28 as shown in FIG. 1. As illustrated in FIGS. 2 and 3, the rotor blade 100 defines an axial direction A, a radial direction R, and a circumferential direction C. The radial direction R extends generally orthogonal to the axial direction A, and the circumferential direction C extends generally concentrically around the axial direction A.

As illustrated in FIGS. 2 and 3, the rotor blade 100 includes a platform 102, which generally serves as a radially inward flow boundary for the combustion gases 34 flowing through the hot gas path 32 of the turbine section 18 (FIG. 1). More specifically, the platform 102 includes a radially inner surface 104 radially spaced apart from a radially outer surface 106. The platform 102 also includes a leading edge face 108 axially spaced apart from a trailing edge face 110. The leading edge face 108 is positioned into the flow of combustion gases 34, and the trailing edge face 110 is positioned downstream from the leading edge face 108. Furthermore, the platform 102 includes a pressure-side slash face 112 circumferentially spaced apart from a suction-side slash face 114.

As shown in FIG. 2, the rotor blade 100 includes shank portion 116 that extends radially inwardly from the radially inner surface 104 of the platform 102. One or more angel wings 118 may extend axially outwardly from the shank portion 116. The shank portion 116 and the platform 102 collectively define a shank pocket 120. In the embodiment shown in FIG. 2, the shank pocket 120 extends circumferentially inwardly into the shank portion 116 from a pressure side 122 thereof. In alternate embodiments, however, the shank pocket 120 may extend circumferentially inwardly into the shank portion 116 from a suction side (not shown) thereof.

The rotor blade 100 also includes a root portion 124, which extends radially inwardly from a shank portion 116. The root portion 124 may interconnect or secure the rotor blade 100 to the rotor disk 26 (FIG. 1). In the embodiment shown in FIG. 2, the root portion 124 has a fir tree configuration. Nevertheless, the root portion 124 may have any suitable configuration (e.g., a dovetail configuration, etc.) as well.

The rotor blade 100 further includes an airfoil 126 that extends radially outwardly from the platform 102 to an airfoil tip 128. As such, the airfoil tip 128 may generally define the radially outermost portion of the rotor blade 100. The airfoil 126 couples to the platform 102 at an airfoil root 130 (i.e., the intersection between the airfoil 126 and the platform 102). In some embodiments, the airfoil root 130 may include a radius or fillet 132 that transitions between the airfoil 126 and the platform 102. In this respect, the airfoil 126 defines an airfoil span 134 extending between the airfoil root 130 and the airfoil tip 128. The airfoil 126 also includes a pressure-side wall 136 and an opposing suction-side wall 138. The pressure-side wall 136 and the suction-side wall 138 are joined together or interconnected at a leading edge 140 of the airfoil 126, which is oriented into the flow of combustion gases 34. The pressure-side wall 136 and the suction-side wall 138 are also joined together or interconnected at a trailing edge 142 of the airfoil 126, which is spaced downstream from the leading edge 140. The pressure-side wall 136 and the suction-side wall 138 are continuous about the leading edge 140 and the trailing edge 142. The pressure-side wall 136 is generally concave, and the suction-side wall 138 is generally convex.

Figure 4:
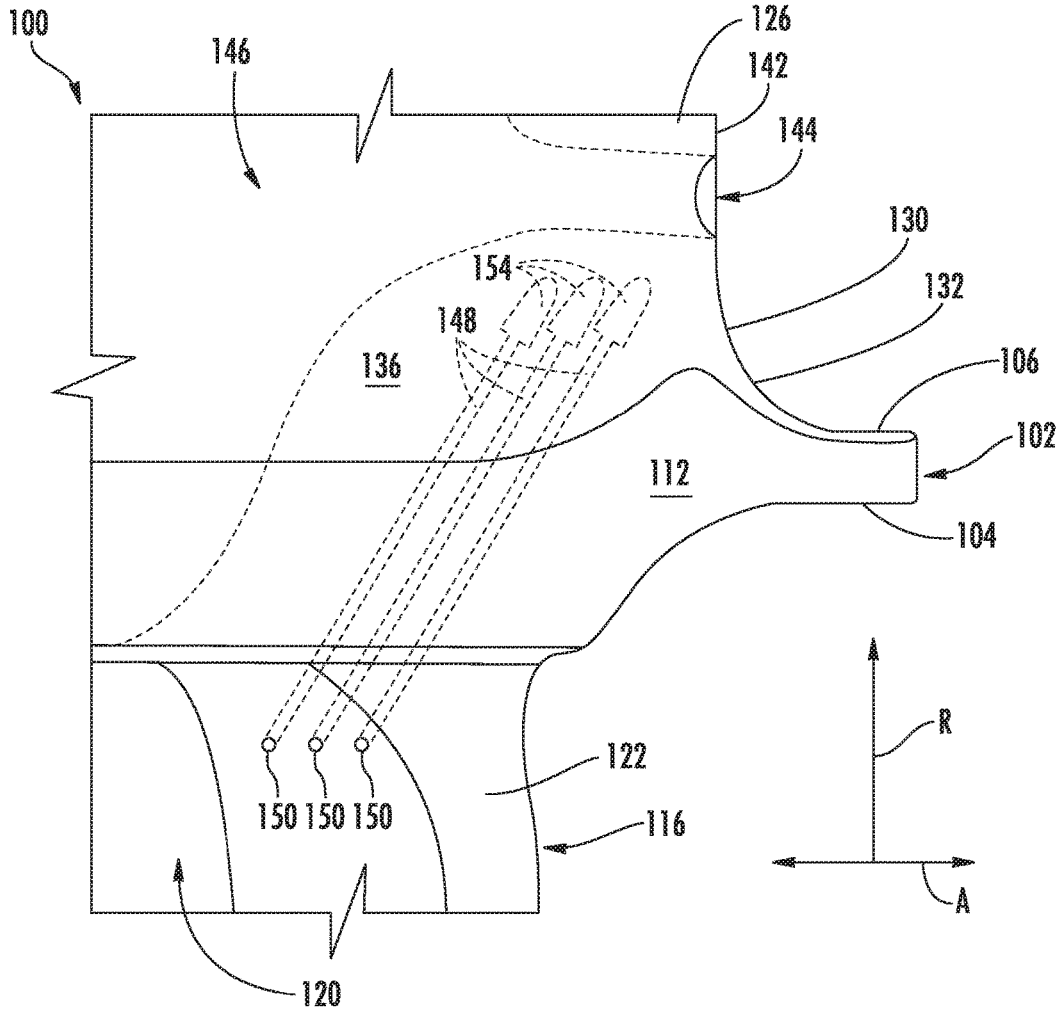
FIG. 4 is enlarged side view of a portion of the rotor blade shown in FIGS. 2 and 3, illustrating a plurality of cooling passages.
Figure 5:
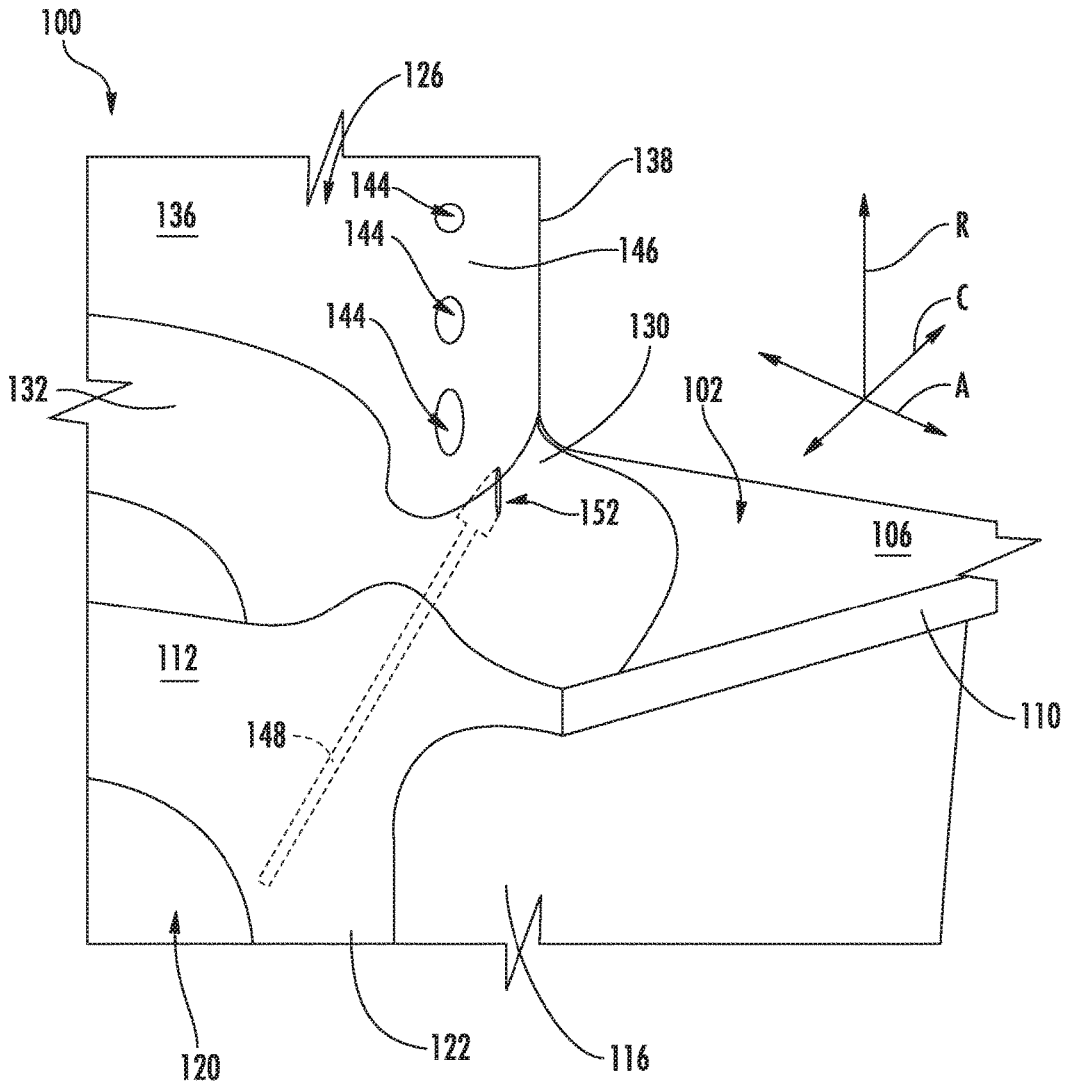
FIG. 5 is enlarged perspective view of a portion of the rotor blade shown in FIGS. 2 and 3, further illustrating one of the plurality of cooling passages.
Figure 6:
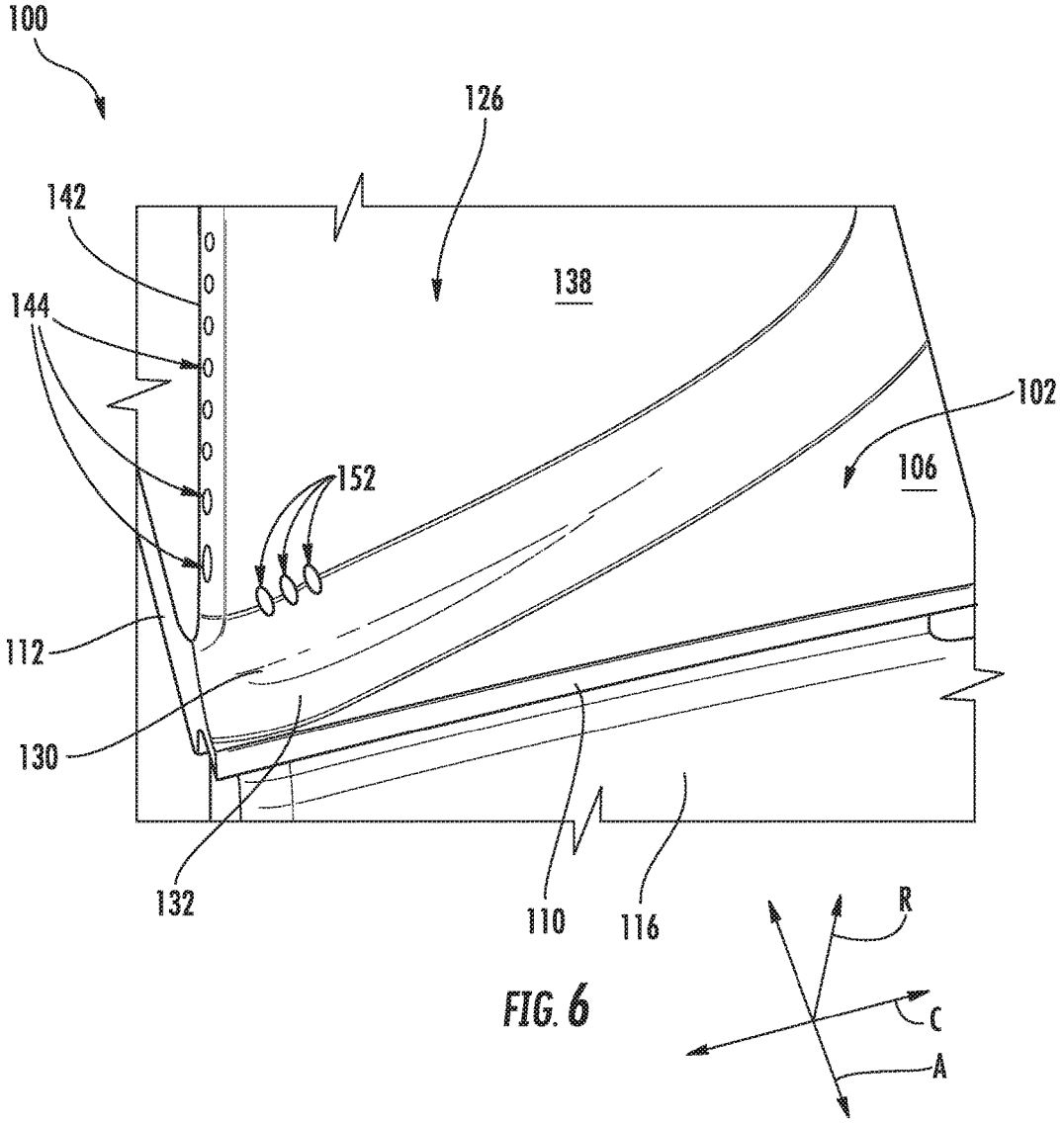
FIG. 6 is alternate perspective view of a portion of the rotor blade shown in FIGS. 2 and 3, illustrating a plurality of outlets corresponding to the plurality of cooling passages shown in FIG. 4.

As illustrated in FIGS. 4-6, the airfoil 126 may define one or more trailing edge apertures 144 in fluid communication with an internal cooling circuit 146. More specifically, the internal cooling circuit 146 cools the airfoil 126 by routing cooling air therethrough in, e.g., a serpentine path. In some embodiments, the internal cooling circuit 146 may receive cooling air through an intake port (not shown) defined by the root portion 124 of the rotor blade 100. The internal cooling circuit 146 may exhaust the cooling air through the one or more trailing edge apertures 144 defined by the airfoil 126 and positioned along the trailing edge 142 thereof. In the embodiment shown in FIGS. 4-6, the radially innermost of the one or more trailing edge apertures 144 is positioned radially outwardly from the airfoil root 130. Nevertheless, the radially innermost aperture 144 of the one or more trailing edge apertures 144 may be partially or entirely defined by the airfoil root 130 in other embodiments as well.

The rotor blade 100 further defines one or more cooling passages 148 that cool the portions of the airfoil root 130 and the platform 102 positioned proximate thereto. In the embodiment illustrated in FIG. 4, the rotor blade 100 defines three cooling passages 148. Nevertheless, the rotor blade 100 may define more or less cooling passages 148 as is necessary or desired. In fact, the rotor blade 100 may define any number of cooling passages 148 so long as the rotor blade 100 defines at least one cooling passage 148.

Each of the one or more cooling passages 148 extend from a corresponding cooling passage inlet 150 to a corresponding cooling passage outlet 152. As illustrated in FIG. 4, each of the cooling passage inlets 150 directly couples to and is in fluid communication with the shank pocket 120. Each of the cooling passage outlets 152 are in fluid communication with the hot gas path 32. In this respect, cooling air from the shank pocket 120 may flow through the one or more cooling passages 148 and exit into the hot gas path 32, thereby cooling portions of the airfoil root 130 and the platform 102.

The platform 102, the airfoil 126, and/or the shank portion 116 collectively define the one or more cooling passages 148. In the embodiments illustrated in FIGS. 4-6, the shank portion 116 defines the cooling passage inlets 150, and the suction side wall 138 of the airfoil 126 defines the cooling passage outlets 152. As such, the cooling passages 148 extend from the shank pocket 120 positioned on the pressure side 122 of the shank portion 116 through the shank portion 116 and platform 102 and out of the suction side wall 138 of the airfoil 126. In alternate embodiments, the portion of the platform 102 defining the radially outer boundary of the shank pocket 120 may define the cooling passage inlets 150. In these embodiments, the shank portion 116 may not define any portion of the one or more cooling passages 148. In additional embodiments, the platform 102 may define the cooling passage outlets 152. In these embodiments, the airfoil 126 may not define any portion of the one or more cooling passages 148. Furthermore, as mentioned above, the shank pocket 120 may be defined by the suction side (not shown) of the shank portion 116. In such embodiments, the pressure side wall 136 of the airfoil 126 may define the cooling passage outlets 152. In this respect, the one or more cooling passages 148 extend from the shank pocket 120 defined by the suction side of the shank portion 116 through the shank portion 116 and platform 102 and out of the pressure side wall 136 of the airfoil 126.

In the embodiments illustrated in FIGS. 4-6, the one or more cooling passages 148 are positioned entirely radially inwardly from all of the one or more trailing edge apertures 144. That is, the cooling passage inlets 150 and the cooling passage outlets 152 are positioned radially inwardly from the radially innermost trailing edge aperture 144. More specifically, the cooling passage inlets 150 are positioned radially inwardly from and the cooling passage outlets 152 are positioned radially outwardly from the radially outer surface 106 of the platform 102. In fact, the cooling passage inlets 150 are positioned radially inwardly from the radially inner surface 104 of the platform 102 as well in the embodiment shown in FIG. 4. Nevertheless, the one or more cooling passages 148 may be positioned only partially radially inwardly from the radially innermost trailing edge aperture 144 in other embodiments. That is, the cooling passages outlets 152 may be radially aligned with or positioned radially outwardly from the radially innermost trailing edge aperture 144 in such embodiments.

In some embodiments, the cooling passage outlets 152 are partially defined by the airfoil root 130. In the embodiments illustrated in FIGS. 5 and 6, for example, the cooling passage outlets 152 are partially defined by the airfoil root 130 and partially defined by the suction side wall 138 of the airfoil 126. That is, one portion of the cooling passage outlets 152 extends through the airfoil root 130 and another portion of the cooling passage outlet 152 extends through the suction side wall 138. In alternate embodiments, the cooling passage outlets 152 may be partially defined by the airfoil root 130 and partially defined by the platform 102. In further embodiments, the cooling passage outlets 152 may be entirely defined by the suction side wall 138, the pressure side wall 136, the airfoil root 130, or the platform 102.

As illustrated in FIGS. 4 and 5, the one or more trailing edge apertures 144 are positioned axially and circumferentially between the cooling passage inlets 150 and the cooling passage outlets 152 of each of the one or more cooling passages 148. Since each cooling passage 148 extends from a corresponding cooling passage inlet 150 to a corresponding cooling passage outlet 152, a portion of each of the one or more cooling passages 148 is axially and circumferentially aligned with and radially spaced apart from all of the one or more trailing edge apertures 144. In this respect, the one or more cooling passages 148 direct cooling air through portions of the platform 102 and the airfoil 126 located radially inwardly from the one or more trailing edge apertures 144. In alternate embodiments, the one or more cooling passages 148 may not cross under the one or more trailing edge apertures 144.

In the embodiments shown in FIG. 4, the cooling passage inlets 150 of each of the one or more cooling passages 148 are radially aligned. Similarly, the cooling passage outlets 152 of each of the one or more cooling passages 148 are also radially aligned as illustrated in FIG. 6. Nevertheless, one or more of the cooling passage inlets 150 may be radially spaced apart from the other cooling passage inlets 150 in alternate embodiments. Furthermore, one or more of the cooling passage outlets 152 may be radially spaced apart from the other cooling passage outlets 152 as well.

In the embodiments shown in FIG. 4-6, the one or more cooling passages 148 have a circular cross-sectional shape. Nevertheless, the one or more cooling passages 148 may have any suitable shape (e.g., elliptical, oval, rectangular, etc.). Furthermore, all of the cooling passages 148 have the same cross-sectional shape (i.e., circular) in the embodiments shown in FIGS. 4-6. In other embodiments, however, some of the cooling passages 148 may have different cross-sectional shapes than other cooling passages 148.

In some embodiments, the one or more cooling passages 148 may have a diffused profile. More specifically, the cross-sectional area of the cooling passage 148 increases from the cooling passage inlet 150 to the cooling passage outlet 152 in embodiments where the cooling passage 148 has a diffused profile. In some embodiments, however, the cross-sectional area of the cooling passage 148 may decrease from the cooling passage inlet 150 to the cooling passage outlet 152. Furthermore, the one or more cooling passages may also have a constant cross-section area as shown in FIGS. 4 and 5.

Each of the one or more cooling passages 148 may optionally include a coating collector 154 to prevent a coating (e.g., a thermal barrier coating) applied to the rotor blade 100 from obstructing the cooling passage 148. As illustrated in FIGS. 4 and 5, each of the coating collectors 154 is an enlarged cavity positioned circumferentially around the cooling passage outlet 152 (i.e., similar to a counter-bore). In this respect, the coating collectors 154 collect any excess coating that enters the corresponding cooling passage outlet 152, thereby preventing the coating from blocking the cooling passage 148.

As mentioned above, the one or more cooling passages 148 direct cooling air from the shank pocket 120 to the hot gas path 32, thereby cooling portions of the platform 102 and the airfoil 126. As mentioned above, the platform 102 and the airfoil 126 are exposed to the combustion gases 34, which increase the temperature thereof. The shank pocket 120, however, may contain cooling air that was, e.g., bled from the compressor section 14. This cooling air enters each of the one or more cooling passage inlets 150 and flows through the corresponding cooling passage 148. While flowing through the cooling passages 148, the cooling air absorbs heat from the platform 102 and the airfoil 126, thereby cooling the same. The spent cooling air then exits the one or more cooling passages 148 through the corresponding cooling passage outlets 152 and flows into the hot gas path 32.

As discussed in greater detail above, each of the one or more cooling passages 148 extends from the corresponding cooling passage inlet 150 to the corresponding cooling passage outlet 152. The cooling passage inlets 150 are coupled to the shank pocket 120, and the cooling passage outlets 152 are defined by the airfoil 126. In this respect, the one or more cooling passages 148 direct cooling air from the shank pocket 120 through the platform 102 and the airfoil 126 and out into the hot has path 32. As such, the one or more cooling passages 148 cool the portions of the platform 102 and the airfoil 126 proximate to the trailing edge 142 that are positioned radially inwardly from the radially innermost trailing edge aperture 144.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A rotor blade for a gas turbine system, comprising:
a platform comprising a radially inner surface and a radially outer surface;
a shank portion extending radially inwardly from the radially inner surface of the platform, the shank portion and the platform collectively defining a shank pocket; and
an airfoil extending radially outwardly from the radially outer surface of the platform, the airfoil defining one or more trailing edge apertures;
wherein the shank portion, the platform, and the airfoil collectively define a cooling passage extending from a cooling passage inlet defined by the shank portion or the platform and directly coupled to the shank pocket through the platform to a cooling passage outlet defined by the airfoil, the cooling passage outlet positioned entirely radially inwardly from all of the one or more trailing edge apertures.

2. The rotor blade of claim 1, wherein the cooling passage outlet is positioned radially outwardly from the radially outer surface of the platform.

3. The rotor blade of claim 1, wherein the cooling passage inlet is positioned radially inwardly from the radially inner surface of the platform.

4. The rotor blade of claim 1, wherein one of the one or more trailing edge apertures is positioned axially and circumferentially between the cooling passage inlet and the cooling passage outlet.

5. The rotor blade of claim 1, wherein a suction side wall of the airfoil defines the cooling passage outlet.

6. The rotor blade of claim 1, wherein the shank pocket is defined by a pressure side of the shank portion.

7. The rotor blade of claim 1, wherein the cooling passage outlet is at least partially defined by a root of the airfoil.

8. The rotor blade of claim 1, wherein the cooling passage comprises a coating collector.

9. The rotor blade of claim 1, wherein the shank portion, the platform, and the airfoil collectively define a plurality of cooling passages.

10. A gas turbine system, comprising:
a compressor section;
a combustion section;
a turbine section comprising one or more rotor blades, each rotor blade comprising:
a platform comprising a radially inner surface and a radially outer surface;
a shank portion extending radially inwardly from the radially inner surface of the platform, the shank portion and the platform collectively defining a shank pocket; and
an airfoil extending radially outwardly from the radially outer surface of the platform, the airfoil defining one or more trailing edge apertures;
wherein the shank portion, the platform, and the airfoil collectively define a cooling passage extending from a cooling passage inlet defined by the shank portion and directly coupled to the shank pocket through the platform to a cooling passage outlet defined by the airfoil, the cooling passage outlet positioned entirely radially inwardly from all of the one or more trailing edge apertures.

11. The gas turbine system of claim 10, wherein the cooling passage outlet is positioned radially outwardly from a radially outer surface of the platform.

12. The gas turbine system of claim 10, wherein the cooling passage inlet is positioned radially inwardly from a radially inner surface of the platform.

13. The gas turbine system of claim 10, wherein one of the one or more trailing edge apertures is positioned axially and circumferentially between the cooling passage inlet and the cooling passage outlet.

14. The gas turbine system of claim 10, wherein the shank pocket is defined by a pressure side of the shank portion.

15. The gas turbine system of claim 10, wherein a suction side wall of the airfoil defines the cooling passage outlet.

16. The gas turbine system of claim 10, wherein the cooling passage outlet is at least partially defined by a root of the airfoil.

17. The gas turbine system of claim 10, wherein the cooling passage comprises a coating collector.

18. The gas turbine system of claim 10, wherein the shank portion, the platform, and the airfoil collectively define a plurality of cooling passages.

* * * * *